US010645975B2

(12) United States Patent
Qiu

(10) Patent No.: US 10,645,975 B2
(45) Date of Patent: May 12, 2020

(54) ATOMIZING HEAD, ATOMIZER AND ELECTRONIC CIGARETTE

(71) Applicant: Changzhou Patent Electronic Technology Co., LTD, Changzhou, Jiangsu (CN)

(72) Inventor: Weihua Qiu, Jiangsu (CN)

(73) Assignee: CHANGZHOU PATENT ELECTRONIC TECHNOLOGY CO., LTD, Changzhou, Jiangsu (CN)

( * ) Notice: Subject to any disclaimer, the term of this patent is extended or adjusted under 35 U.S.C. 154(b) by 157 days.

(21) Appl. No.: 15/920,754

(22) Filed: Mar. 14, 2018

(65) Prior Publication Data

US 2018/0263282 A1 Sep. 20, 2018

(30) Foreign Application Priority Data

Mar. 14, 2017 (CN) ..... 2017 2 0243293 U

(51) Int. Cl.

| | |
|---|---|
| ***A24F 13/00*** | (2006.01) |
| ***A24F 17/00*** | (2006.01) |
| ***A24F 25/00*** | (2006.01) |
| ***A24F 47/00*** | (2020.01) |
| ***H05B 3/44*** | (2006.01) |
| ***B05B 1/24*** | (2006.01) |
| ***H05B 1/02*** | (2006.01) |

(52) U.S. Cl.

CPC ..... *A24F 47/008* (2013.01); *B05B 1/24* (2013.01); *H05B 1/0227* (2013.01); *H05B 3/44* (2013.01); *H05B 2203/021* (2013.01)

(58) Field of Classification Search

CPC ..... A24F 47/008; A24F 47/002; H05B 3/44; B05B 1/24

USPC ..... 131/329, 328

See application file for complete search history.

(56) References Cited

U.S. PATENT DOCUMENTS

| | | | | |
|---|---|---|---|---|
| 9,795,169 | B1 * | 10/2017 | Zhu | A24F 47/008 |
| 2016/0157522 | A1 * | 6/2016 | Zhu | A24F 47/008 131/329 |
| 2017/0119060 | A1 * | 5/2017 | Li | A24F 47/008 |
| 2018/0027874 | A1 * | 2/2018 | Zhu | A24F 47/008 |
| 2018/0049470 | A1 * | 2/2018 | Chen | A24F 47/008 |
| 2018/0071465 | A1 * | 3/2018 | Zhao | A61M 11/042 |
| 2018/0116287 | A1 * | 5/2018 | Dai | A24F 47/008 |
| 2018/0116290 | A1 * | 5/2018 | Li | A24F 47/008 |
| 2018/0199631 | A1 * | 7/2018 | Chen | A24F 47/008 |
| 2019/0124990 | A1 * | 5/2019 | Qiu | A24F 47/008 |
| 2019/0124997 | A1 * | 5/2019 | Qiu | A24F 47/00 |
| 2019/0142069 | A1 * | 5/2019 | Qiu | A24F 47/008 131/329 |
| 2019/0159524 | A1 * | 5/2019 | Qiu | A61M 15/06 |
| 2019/0269177 | A1 * | 9/2019 | Liu | A24F 47/008 |
| 2019/0281899 | A1 * | 9/2019 | Chen | A24F 47/008 |

* cited by examiner

*Primary Examiner* — Hae Moon Hyeon

(74) *Attorney, Agent, or Firm* — Novick, Kim & Lee, PPLC; Allen Xue

(57) ABSTRACT

An electronic cigarette contains an atomizer. The atomizer contains an atomizing head. The atomizing head includes a bracket forming an atomizing chamber at an inner space thereof; an electrode assembled to one end of the bracket; and a heater received in the atomizing chamber, and one end of the heater resisting the electrode.

19 Claims, 8 Drawing Sheets

ATOMIZING HEAD, ATOMIZER AND ELECTRONIC CIGARETTE

CROSS-REFERENCE TO RELATED APPLICATIONS

This application claims priority to Chinese Patent Application No. 201720243293.5, filed on Mar. 14, 2017, entitled "An atomizing head, an atomizer and an electronic cigarette," which is incorporated herein by reference in its entirety.

FIELD

The invention relates to a technical field of smoking simulating, and more particularly, relates to an atomizing head, an atomizer and an electronic cigarette.

BACKGROUND

In the related electronic cigarette, the heater of the atomizing head is generally required to be butt-welled to the heater pin, and then the heater pin is welded to the electrode, thereby realizing an electrical conduction of the heater. In the actual production, the problems such as fracture, deformation, and detachment of the heater pin can easily happen. The production efficiency is low, the cost is high, the service life of the heater is short, and is difficult to replace. In addition, the electrical resistance of the welded portion of the heater pin is relative greater, and a part of energy is loss, therefore, a heat efficiency is reduced, and a normal use of the electronic cigarette is affected.

SUMMARY

Accordingly, it is necessary to provide an atomizing head, an atomizer and an electronic cigarette. The heater of the atomizing head needs not a welding of a pin and directly resists the electrode. It has a long service life and a high heating efficiency.

The technical solution adopted by the invention to solve the problem is:

An atomizing head includes: a bracket forming an atomizing chamber at an inner space thereof; a second electrode assembled to an end of the bracket; and a heater received in the atomizing chamber, and an end of the heater resisting the second electrode.

According to one embodiment, an opposite end of the heater is electrically connected to a sealing cover by resisting.

According to one embodiment, the sealing cover is sleeved on the bracket.

According to one embodiment, the heater is a heater strip, a heater piece or a heater grid.

According to one embodiment, a second insulating member is disposed between the second electrode and the bracket.

According to one embodiment, the second electrode is substantially a hollow cylindrically structure having an opening, the second electrode is provided with a resisting portion protruding inwardly from an inner wall of the second electrode.

According to one embodiment, the atomizing head further includes an absorbing member received in the atomizing chamber, wherein the heater is received in the absorbing member.

According to one embodiment, an end of the sealing cover away from the second electrode is bended inwardly along a radial direction of the sealing cover to form a bending portion, an end of the heater resists the bending portion.

According to one embodiment, the sidewall of the bracket defines a first inlet hole fluidly communicating with the atomizing chamber, the sidewall of the sealing cover defines a second inlet hole fluidly communicating with the first inlet hole, the absorbing member seals the first inlet hole.

According to one embodiment, the atomizing head further includes a liquid stopper, wherein an end surface of the liquid stopper seals the first inlet hole, and an opposite end surface seals the second inlet hole, the liquid stopper is disposed between the bracket and the sealing cover.

According to one embodiment, the absorbing member is made of materials selected from a combination of one, two or more than two kinds of cotton, ceramic, fiber robes, foamy metal, and foamy graphite.

An atomizer includes an atomizing head, wherein the atomizing head includes: a bracket forming an atomizing chamber at an inner space thereof; a second electrode assembled to an end of the bracket; and a heater received in the atomizing chamber, and an end of the heater resisting the second electrode.

According to one embodiment, the atomizer further includes a liquid storage tube, an upper cover assembly, and a seat assembly, wherein the upper cover assembly is positioned on an end of the liquid storage tube, the seat assembly is positioned on an opposite end of the liquid storage tube, the liquid storage tube has an inner space forming a liquid storage chamber, and the atomizing head is received in the liquid storage tube.

According to one embodiment, the upper cover assembly includes an upper cover and a mouth piece slidably connected to the upper cover, the upper cover forms a first ventilation pipe and defines an injection hole, the first ventilation pipe fluidly communicates with the atomizing chamber, the injection hole fluidly communicates with the liquid storage chamber, moving the mouth piece is capable of enabling the mouth piece to fluidly communicates with the first ventilation pipe and the injection hole.

According to one embodiment, the seat assembly includes a base seat and a flow regulating member rotatably sleeved on the base seat.

According to one embodiment, the base seat defines an air intake hole at the sidewall thereof, the sidewall of the flow regulating member defines a flow regulating hole corresponding to the air intake hole, and a communication area between the flow regulating hole and the air intake hole can be adjusted by a rotation of the flow regulating member.

According to one embodiment, the seat assembly further includes a first insulating member and a first electrode, which are assembled to the base seat.

According to one embodiment, the base seat forms a connector tube, which fluidly communicates with the inner space of the base seat. The connector tube extends downwardly from a central portion of the lower end surface of the base seat along an axial direction of the base seat. The first electrode is assembled to the connector tube, and the first insulating member is disposed between the first electrode and the connector tube.

An electronic cigarette includes an atomizing head, wherein the atomizing head includes: a bracket forming an atomizing chamber at an inner space thereof; a second electrode assembled to an end of the bracket; and a heater received in the atomizing chamber, and an end of the heater resisting the second electrode.

An electronic cigarette includes an atomizer, wherein the atomizer includes an atomizing head, the atomizing head includes: a bracket forming an atomizing chamber at an inner space thereof; a second electrode assembled to an end of the bracket; and a heater received in the atomizing chamber, and an end of the heater resisting the second electrode.

BRIEF DESCRIPTION OF THE DRAWINGS

Further descriptions to the present disclosure are made with reference to accompanying drawings and embodiments in the following.

Figure 1:
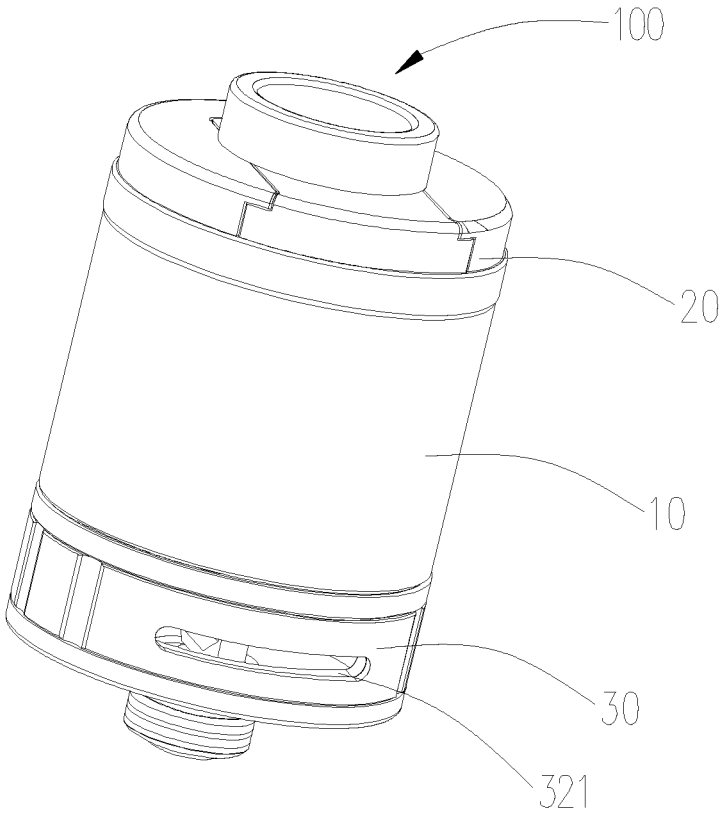
FIG. 1 is an isometric view of an atomizer of a first embodiment of the present disclosure.

The reference numerals for parts in the figures are listed below:

Atomizer 100, Liquid storage tube 10, Upper cover assembly 20,
Seat assembly 30, Atomizing head 40, Upper cover 21,
Fixing seat 22, Mouth piece 23, Sealing member 24
Base seat 31, Flowing regulating member 32, First insulating member 33,
First assembly 34, Bracket 41, Liquid stopper 42
Sealing cover 43, Second electrode 44, Second insulating member 45
Absorbing member 46, Heater 47, Liquid storage chamber 101
First ventilation pipe 211, Injection hole 212, External threads 213,
Sliding slot 221, Latching groove 222, Sliding portion 231,
Sucking portion 232, Limiting portion 233, Connector tube 311,
Sleeving portion 312, air intake hole 313, flow regulating hole 321,
First inlet hole 411, Atomizing chamber 412, Second inlet hole 431,
Second ventilation pipe 432, inner thread 433, bending portion 434,
Resisting portion 441, Conical hole 442.

DETAILED DESCRIPTION OF THE PREFERRED EMBODIMENT

Technical solutions in the embodiments of the present application will be described clearly and thoroughly hereinafter with reference to the accompanying drawings. Apparently, the embodiments described herein are merely parts of but not exclusive embodiments of the present application. All alternative embodiments obtained by those skilled in the art based on the embodiments of the present application without creative works shall fall within the protection scope of the present application.

The invention is illustrated with reference to accompanying drawings. The accompanying drawings are schematic views that illustratively shows fundamental structures of an exemplary embodiment of the invention. Thus, merely the constructions related to the invention are shown.

Figure 2:
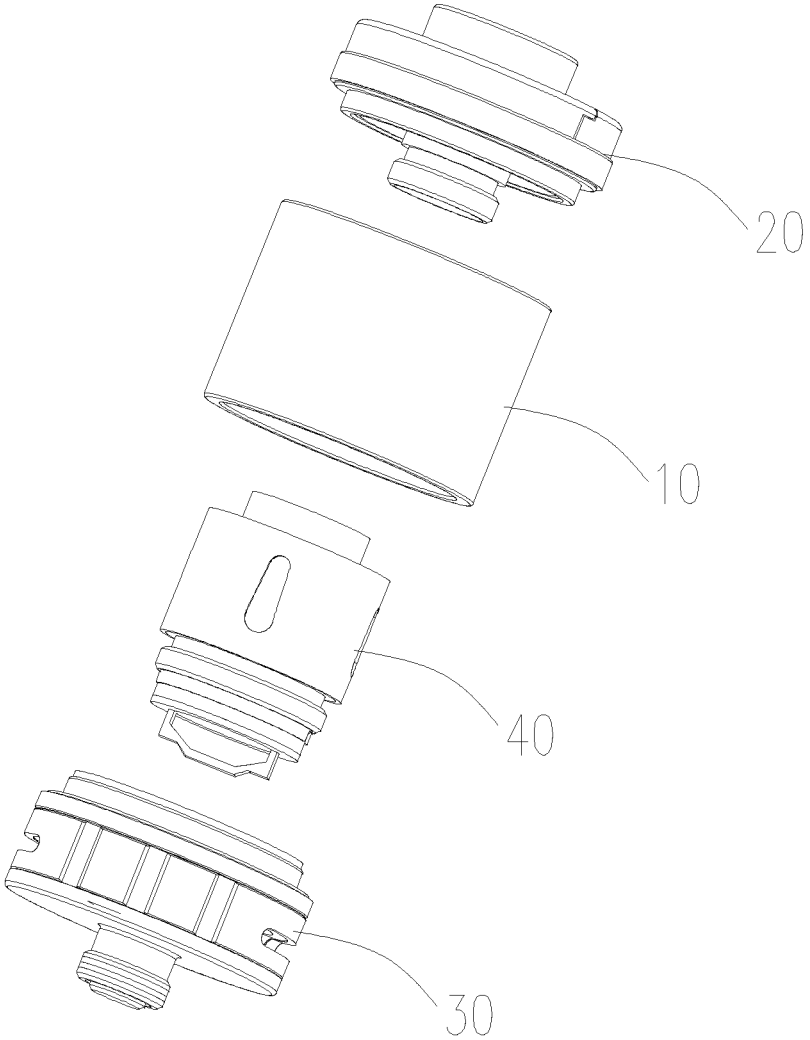
FIG. 2 is an exploded view of the atomizer of FIG. 1.

Referring to FIG. 1 and FIG. 2, the present disclosure provides an electronic cigarette (not shown), the electronic cigarette includes an atomizer 100 and a battery assembly (not shown) electrically connected to the atomizer 100. The atomizer 100 includes a liquid storage tube 10, an upper cover assembly 20 positioned on an end of the liquid storage tube 10, a seat assembly 30 positioned on an opposite end of the liquid storage tube 10, and an atomizing head 40 received in the liquid storage tube 10.

Figure 6:
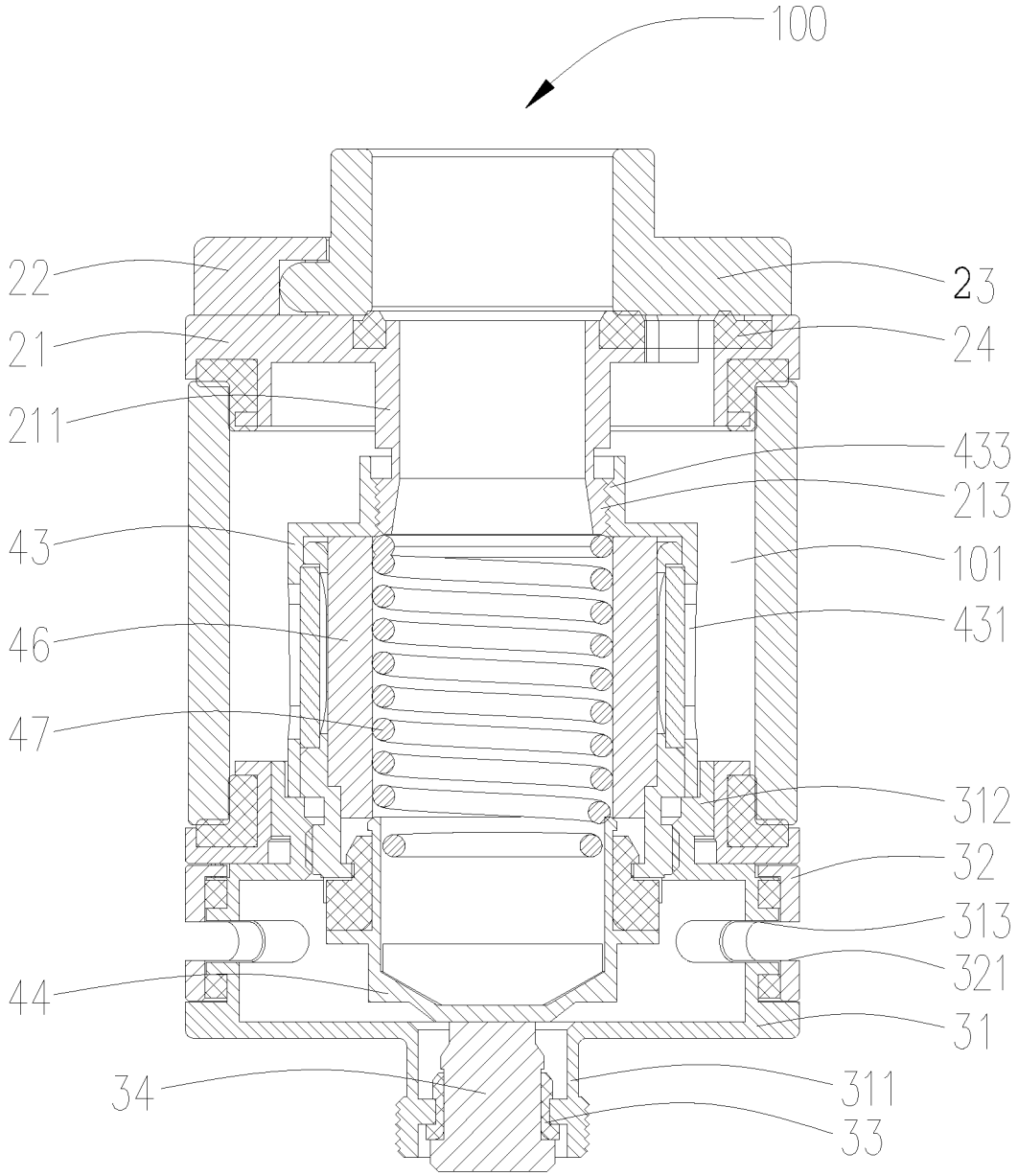
FIG. 6 is a cross-sectional view of the atomizer of FIG. 1.
Figure 7:
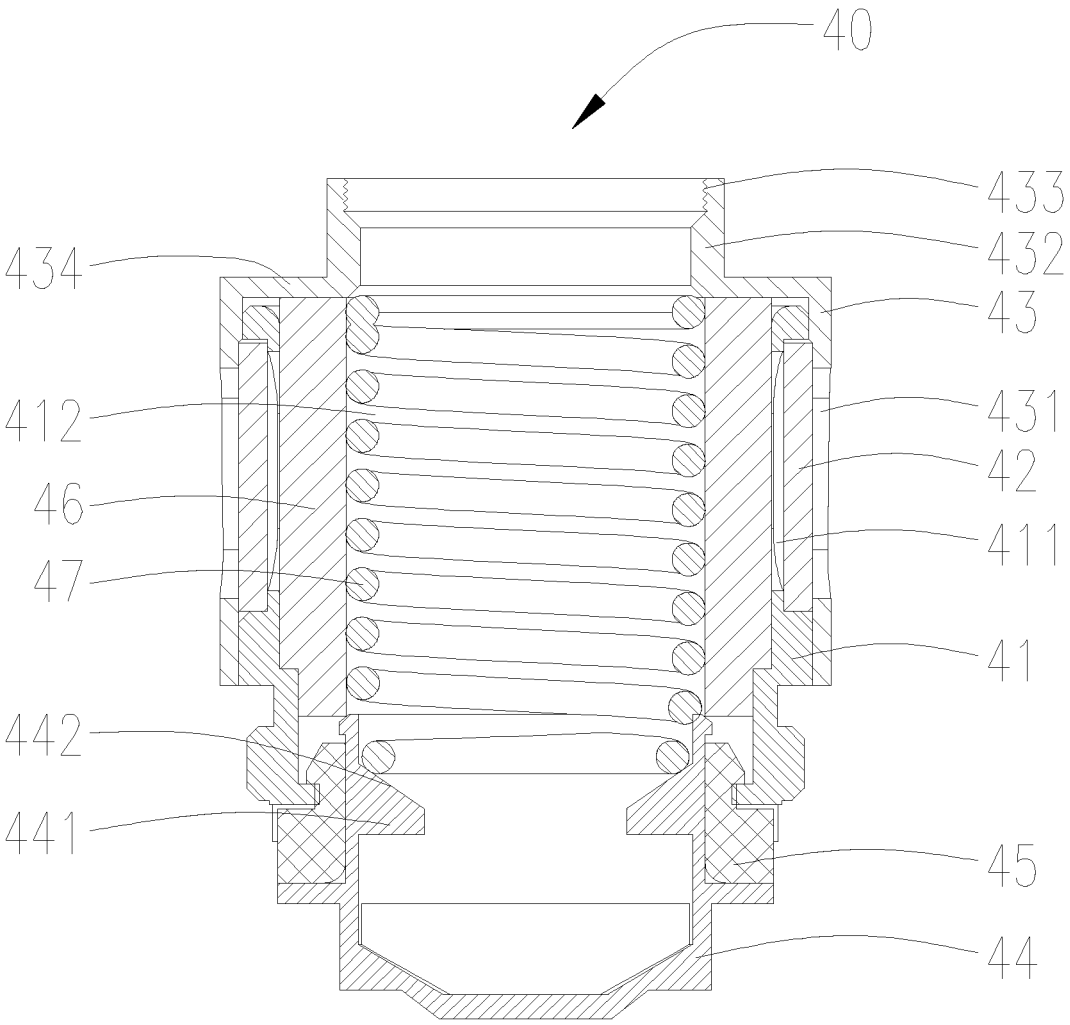
FIG. 7 is a cross-sectional view of an atomizing head of a second embodiment of the present disclosure.
Figure 8:
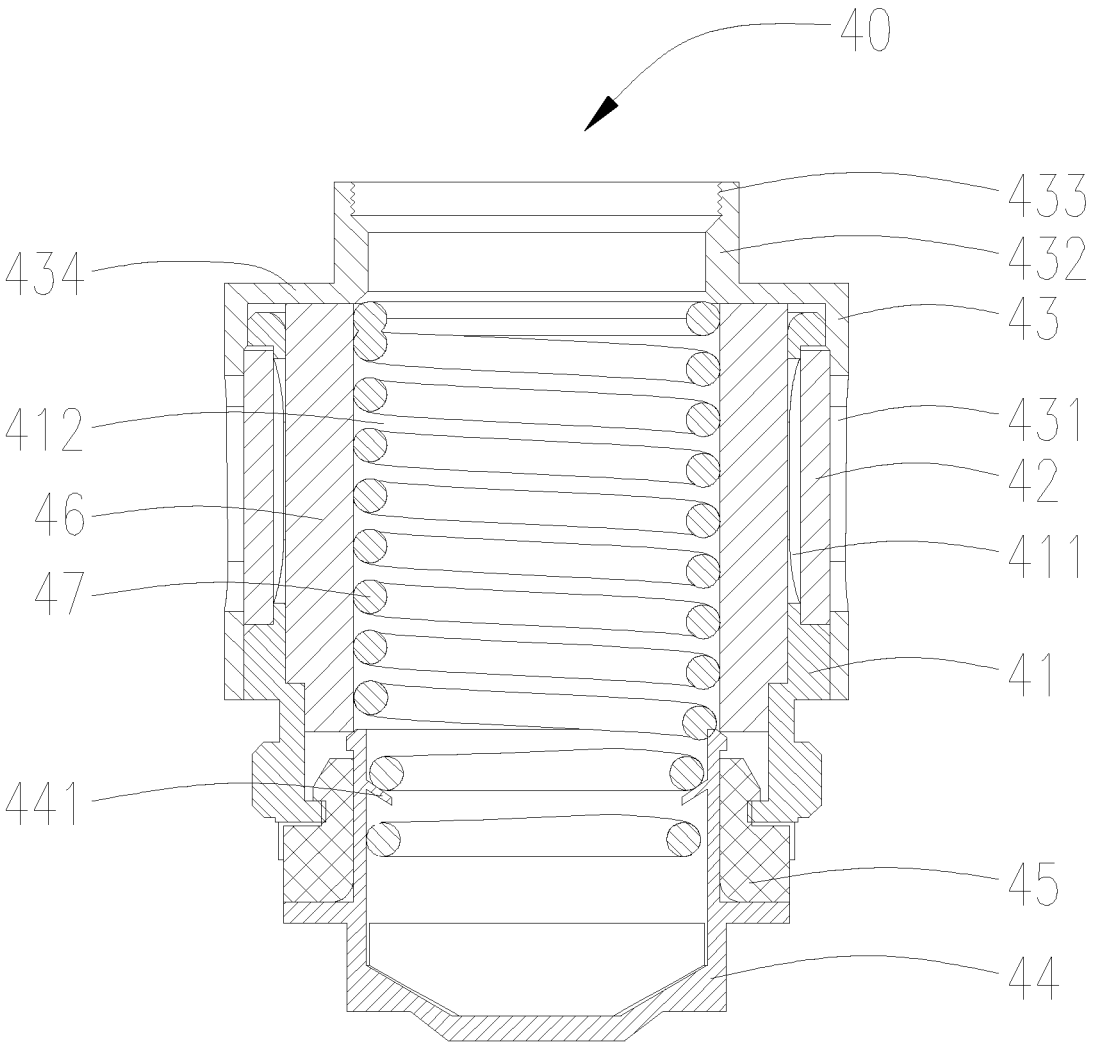
FIG. 8 is a cross-sectional view of an atomizing head of a third embodiment of the present disclosure.

Referring to FIG. 6, the liquid storage tube 10 is substantially a hollow cylindrically structure having two openings at opposite ends of the liquid storage tube 10. The liquid storage tube 10 has an inner space forming a liquid storage chamber 101 configured for storing liquid. In the illustrated embodiment, the liquid storage tube 10 is a stainless steel tube. It is understood, in alternative embodiments (not shown), the liquid storage tube 10 can be made of transparent material or translucent material, so that the user can observes the residual amount of liquid in the liquid storage chamber 101 though the liquid storage tube 10 to facilitate user to add liquid.

Figure 3:
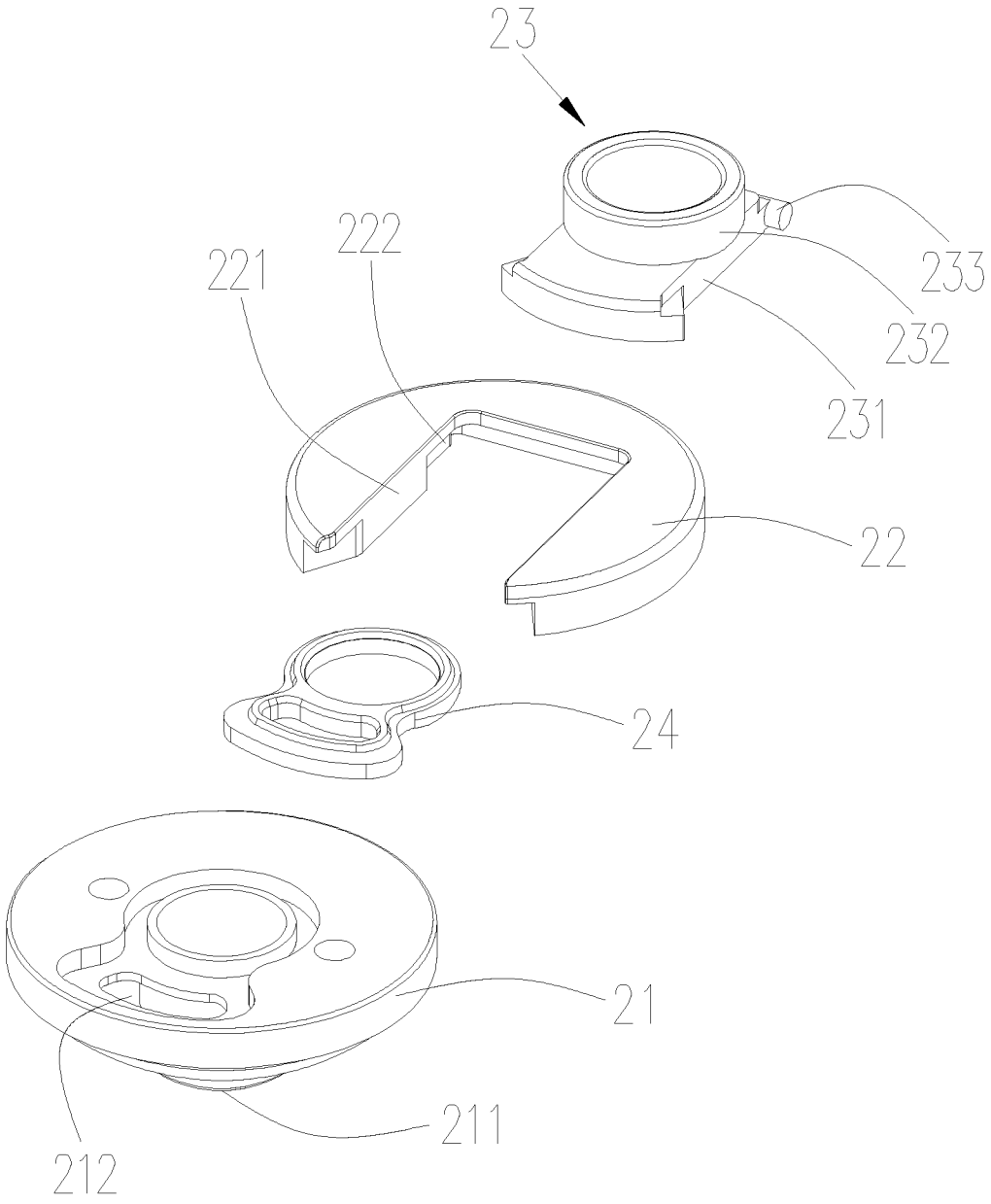
FIG. 3 is an exploded view of an upper cover assembly of the atomizer of FIG. 2.

Referring to FIG. 3, the upper cover assembly 20 includes an upper cover 21, a fixing seat 22 fixedly assembled to the upper cover 21, and a mouth piece 23 slidably connected to the fixing seat 22.

The upper cover 21 is substantially a hollow cylindrically structure having an opening at the lower end of the upper cover 21. The upper cover 21 is connected to an upper end of the liquid storage tube 10. The upper cover 21 forms a first ventilation pipe 211 extending downwardly from the central portion of the upper end surface of the upper cover 21 along an axial direction of the upper cover 21. Opposite ends of the first ventilation pipe 211 fluidly communicate with each other. The upper cover 21 defines an injection hole 212 surrounding the first ventilation pipe 211, the injection hole 212 is located on the upper end surface of the upper cover 21. The injection hole 212 fluidly communicates with the liquid storage chamber 101 to facilitate user to inject liquid into the liquid storage chamber 101 via the injection hole 212.

Further, referring to FIG. 6, the first ventilation pipe 211 is provided with external threads 213 on an outer circumference surface of the lower end of the first ventilation pipe 211, facilitating for connecting the first ventilation pipe 211 with the atomizing head 40.

The fixing seat 22 has a substantially circular plate structure, the fixing seat 22 is fixedly connected to an upper end surface of the upper cover 21. The fixing seat 22 defines a U-shaped sliding slot 221, the sliding slot 221 cuts through an outer circumference surface of the fixing seat 22, and fluidly communicates with the first ventilation pipe 211 and the injection hole 212. The sliding slot 221 defines a pair of latching grooves 222 on an opposite sidewalls of the sliding slot 221 respectively, the pair of latching grooves 222 is located away from the cutout of the sliding slot 221. The latching groove 222 cuts through the lower end surface of the fixing seat 22.

In the illustrated embodiment, the upper end surface of the upper cover 21 is connected to a fixing pin (not shown), the fixing seat 22 defines a fixing hole (not shown) engaging with the fixing pin. When connecting, a connection of the fixing seat 22 and the upper cover 21 is established by an interference fit between the fixing pin and the fixing hole. It is understood that, the upper cover 21 and the fixing seat 22 can be connected by screws or latching.

The mouth piece 23 includes a sliding portion 231, a sucking portion 232 and a limiting portion 233. The sucking portion 232 and the limiting portion 233 are connected to the sliding portion 231.

The sliding portion 231 engages with the sliding slot 221 and is capable of sliding within the sliding slot 221. The lower end surface of the sliding portion 231 abuts against the upper end surface of the upper cover 21. The sucking portion 232 has a tubular structure, the sucking portion 232 is affixed to the upper end surface of the sliding portion 231 and extends through the sliding portion 231. The limiting portion 233 has a columnar structure, the limiting portion 233 is affixed to an end of the sliding portion 231 and is capable of sliding within the latching groove 222. During the sliding procedure of the mouth piece 23, the limiting portion 233 can latch with the sidewall of the latching groove 222, thereby avoiding a separation of the mouth piece 23 from the fixing seat 22. The mouth piece 23 is assembled in position, the sucking portion 232 is aligned to and fluidly communicates with the first ventilation pipe 211, user can perform a sucking action. When the mouth piece 23 slides outwardly, the sucking portion 232 and the injection hole 212 are enabled to be communicated, user can preforms a liquid injection action. It is understood, when user sucks, the injection hole 212 is sealed by the sliding portion 231 to avoid the liquid to be polluted, thus ensuring the liquid to be clean.

When the upper cover assembly 20 is assembled, firstly, the mouth piece 23 is assembled to the fixing seat 22 upwardly, and then the fixing seat 22 is fixedly assembled to the upper cover 21.

In order to avoid the gas and the liquid being leaked from the abutting portions between the upper cover 21 and the mouth piece 23, a sealing member 24 is positioned between the upper cover 21 and the mouth piece 23. At the same time, it can improve a touch sense of the mouth piece 23 when the mouth piece 23 slides, thereby the user's experience is improved. It is understood that, the sealing member 24 is made of silica gel or rubber.

It is understood that, in an alternative embodiment (not shown), the upper cover 21 and the fixing seat 22 are integrally formed, at the time, the mouth piece 23 is still capable of sliding in the sliding slot 221. It can also be understood that, the upper cover 21, the fixing seat 22 and the mouth piece 23 are integrally formed. When the liquid needs to be added, merely the upper cover 21 is required to be disassembled to enable the upper end of the liquid storage chamber 101 to be opened.

Referring to FIG. 6, the seat assembly 30 includes a base seat 31, a flow regulating member 32, a first insulating member 33, and a first electrode 34. The flow regulating member 32 is rotatably sleeved on the base seat 31, the first insulating member 33 and the first electrode 34 are assembled to the base seat 31.

The base seat 31 has a substantially hollow cylindrically structure with an opening at the upper end. The base seat 31 is connected to the lower end of the liquid storage tube 10. The base seat 31 forms a connector tube 311 fluidly communicating the inner space of the base seat 31. The connector tube 311 extends downwardly from a central portion of the lower end surface of the base seat 31 along an axial direction of the base seat 31. The first electrode 34 is assembled to the connector tube 311, the first insulating member 33 is disposed between the first electrode 34 and the connector tube 311, providing an insulating function. It is understood that, the first insulating member 33 can be a silica gel ring or a rubber ring. Further, the battery pack is connected to the connector tube 311 by screws, thereby establishing a connection between the battery pack and the atomizer 100. The first electrode 34 is electrically connected to the anode of the battery pack while the connector tube 311 is electrically connected to the cathode of the battery pack.

In order to connect the base seat 31 with the liquid storage tube 10, the upper end of the base seat 31 extends upwardly along an axial direction of the base seat 31 to form a sleeving portion 312. The sleeving portion 312 is tightly plugged into the lower end of the liquid storage tube 10, thereby establishing a connection between the base seat 31 and the liquid storage tube 10.

The sidewall of the base seat 31 is provided with two air intake holes 313, the two air intake holes 313 are opposite to each other. It is understood that, the number of the air intake holes 313 can be one, two or more than two.

The flow regulating member 32 is substantially a hollow cylindrically structure having two openings at opposite ends of the flow regulating member 32. The sidewall of the flow regulating member 32 defines a flow regulating hole 321 corresponding to the air intake hole 313. The communication area between the flow regulating hole 321 and the air intake hole 313 can be adjusted by a rotation of the flow regulating member 32, thereby controlling the volume of air which enters the electronic cigarette.

In order to improve a connection tightness between the liquid storage tube 10 and the upper cover 21, and a connection tightness between the liquid storage tube 10 and the base seat 31. A sealing ring (not labeled) is provided on the connection portion between the liquid storage tube 10 and the upper cover 21, a sealing ring (not labeled) is provided on the connection portion between the liquid storage tube 10 and the base seat 31.

Figure 4:
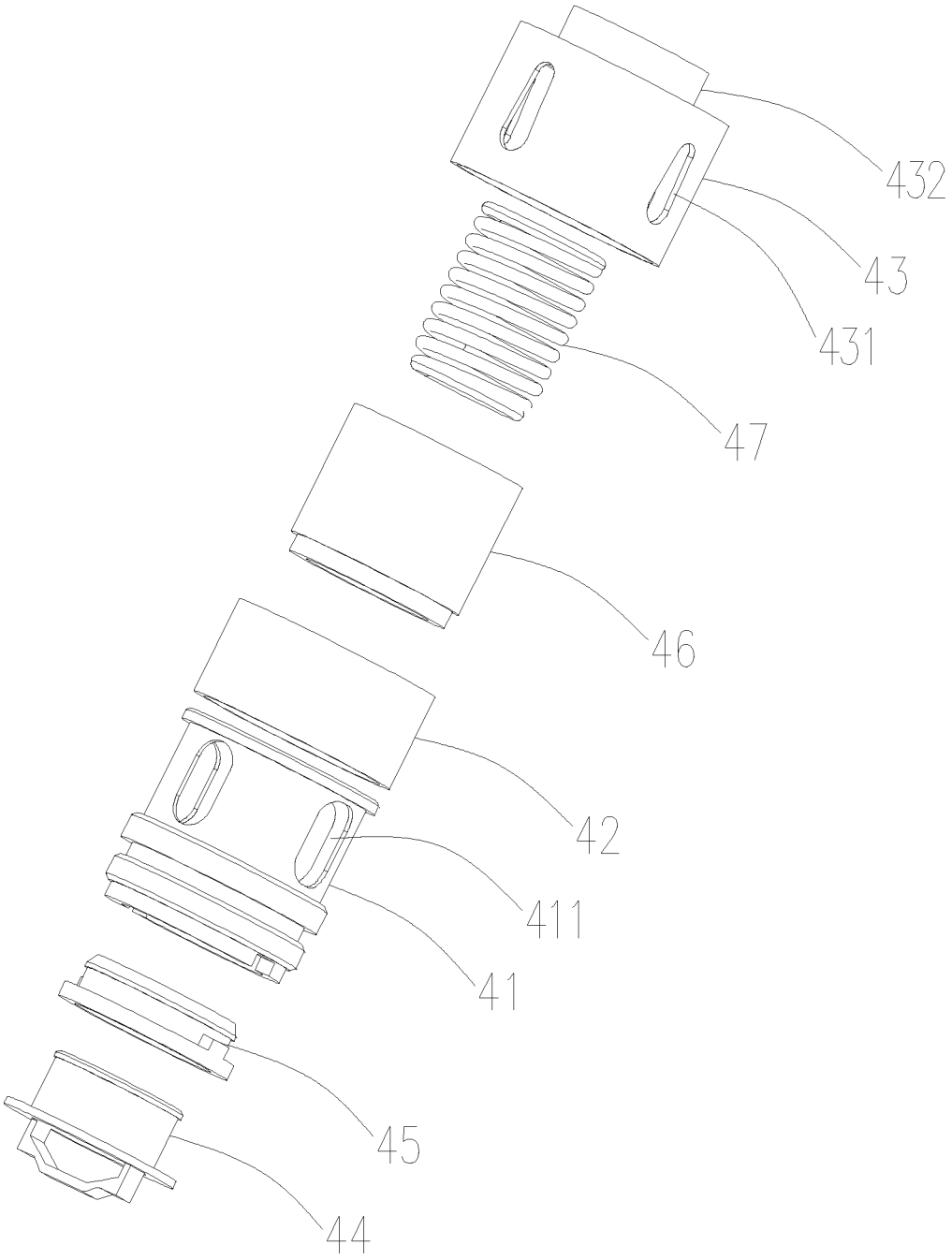
FIG. 4 is an exploded view of an atomizing head of the atomizer of FIG. 2.
Figure 5:
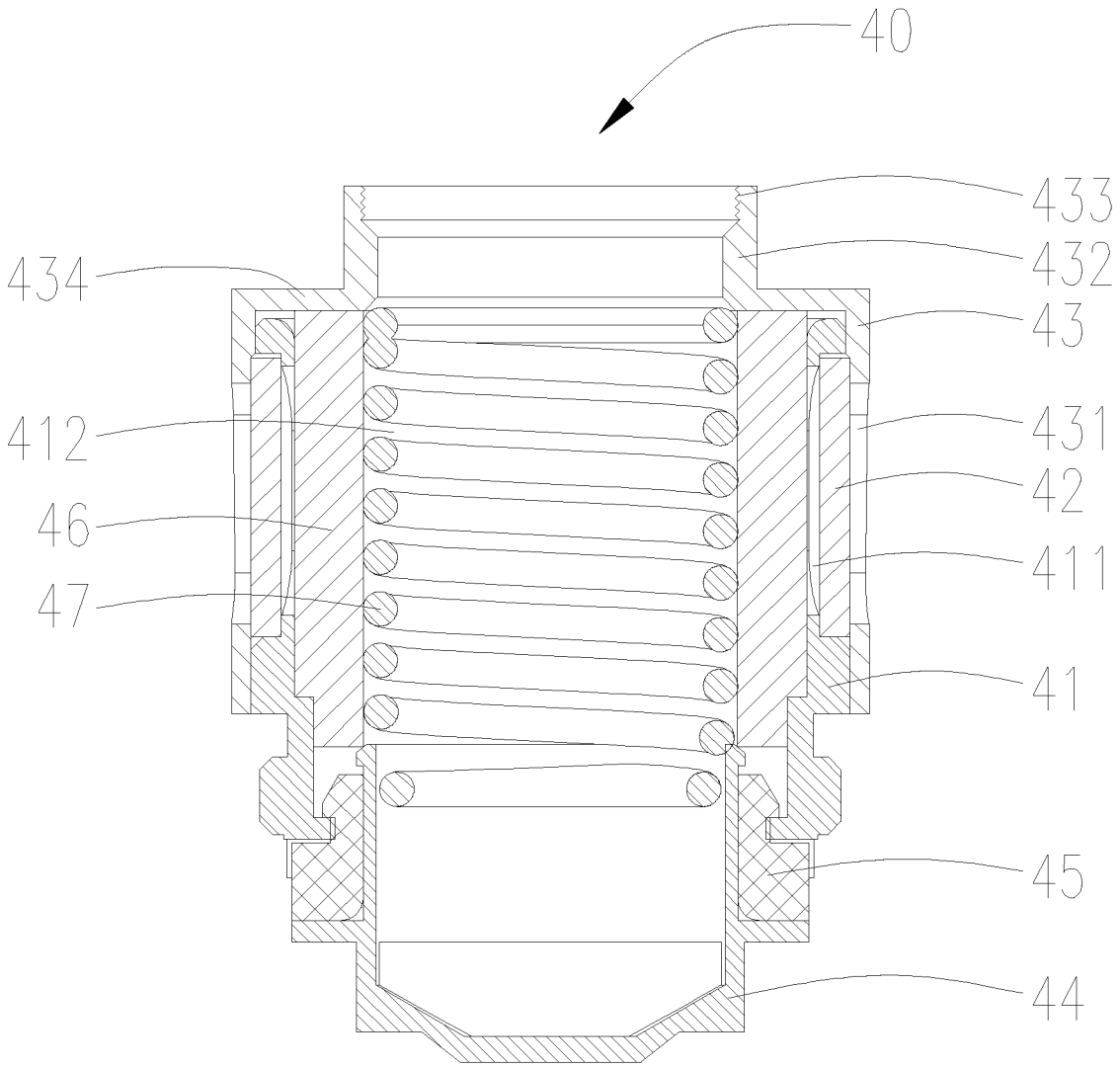
FIG. 5 is a cross-sectional view of an atomizing head of the atomizer of FIG. 2.

Referring to FIG. 4 and FIG. 5 at the same time, the atomizing head 40 is received in the liquid storage chamber 101, the atomizing head 40 includes a bracket 41, a liquid stopper 42, a sealing cover 43, a second electrode 44, a second insulating member 45, an absorbing member 46, and a heater 47.

The bracket 41 is substantially a hollow cylindrically structure having two openings at opposite ends of the bracket 41. The lower end of the bracket 41 is fixedly connected to the sleeving portion 312 of the base seat 31 by an interference fit. Referring to FIG. 5, the inner space of the bracket 41 forms an atomizing chamber 412. The sidewall of the bracket 41 defines four first inlet holes 411 that are uniformly distributed. The first inlet holes 411 fluidly communicate with the atomizing chamber 412. It is understood that the number of the first inlet holes 411 can be one, two, three, four or more than four, which is not limited hereby.

The liquid stopper 42 is sleeved on the bracket 41 and seals the first inlet hole 411. The liquid stopper 42 has an ability to absorb liquid. It is understood, the liquid stopper 42 can be made of materials selected from a combination of one, two or more than two kinds of cotton, ceramic, fiber robes, foamy metal, and foamy graphite. In the illustrated embodiment, the liquid stopper 42 is cotton.

The sealing cover 43 is substantially a hollow cylindrically structure having two openings at opposite ends of the sealing cover 43. The sealing cover 43 is sleeved on the bracket 41, and the sealing cover 43 partially contacts the bracket 41. The sidewall of the sealing cover 43 defines a second inlet hole 431, the second inlet hole 431 fluidly communicates with the liquid storage chamber 101 and the first inlet hole 411. The liquid stopper 42 seals the second inlet hole 431 and is disposed between the sealing cover 43 and the bracket 41. When operation, the liquid in the liquid storage chamber 101 flows through the second inlet hole 431, the liquid stopper 42, the first inlet hole 411 and enters into the atomizing chamber 412. The liquid stopper 42 can prevent the overflown liquid in the liquid storage chamber 101 from entering into the atomizing chamber 412, avoiding the occasions of a liquid leakage or an immersing of the heater 47 by the liquid, which affects the regular operation.

The upper end of the sealing cover 43 is bended inwardly along a radial direction of the sealing cover 43 to form a bending portion 434, and a terminal of the bending portion 434 extends upwardly along an axial direction of the sealing cover 43 to from a second ventilation pipe 432. The second ventilation pipe 432 fluidly communicates with the atomizing chamber 412. The upper end of the second ventilation pipe 432 is provided with inner threads 433 engaging the external threads 213. The sealing cover 43 is detachably connected to the upper cover 21 via an engaging between the inner threads 433 and the external threads 213.

Also referring to FIG. 6, the second electrode 44 is assembled to the lower end of the bracket 41, the lower end of the second electrode 44 resists the first electrode 34. The second electrode 44 is substantially a hollow cylindrically structure having two openings at opposite ends of the second electrode 44. The air intake hole 313 and the atomizing chamber 412 both fluidly communicate with the second electrode 44, facilitating for outside air enters into the atomizing chamber 412 via the flow regulating hole 321, the air intake hole 313 and the second electrode 44.

The second insulating member 45 is disposed between the second electrode 44 and the bracket 41, providing an insulating function. It is understood that, the second insulating member 45 can be a rubber ring or a silica gel ring.

The absorbing member 46 is received in the atomizing chamber 412 and seals the first inlet hole 411. The absorbing member 46 processes an ability to absorb liquid. It is understood that the absorbing member 46 can be made of materials selected from a combination of one, two or more than two materials among cotton, ceramic, fiber robes, foamy metal, and foamy graphite. In the illustrated embodiment, the liquid stopper 42 is cotton.

The heater 47 is received within the absorbing member 46, the lower end of the heater 47 resists the second electrode 44, thereby electrically connecting the heater 47 with the anode via the second electrode 44. The upper end of the heater 47 resists the bending portion 434 of the sealing cover 43, thereby electrically connecting the heater 47 with the cathode via the sealing cover 43, the bracket 41, and the base seat 31. It is understood that, the heater 47 can be a heater strip, a heater sheet, or a heater grid. In the illustrated embodiment, the heater 47 is a heater strip.

During operation, the absorbing member 46 absorbs liquid via the first inlet hole 411. The liquid is heated by the heater 47 and is atomized to form smog which is full of the atomizing chamber 412. The smog is mixed with air and driven by the air flow to successively pass through the second ventilation tube 432, the first ventilation tube 211, and the sucking portion 232, and reaches the user's mouth.

Compared to the traditional structures, in the atomizing head 40 of the present disclosure, the heater 47 needs not a welding of a pin, opposite ends of the heater 47 are directly and electrically connected to the electrodes by resisting, it facilitates for a production and lowers the cost, it has a long service life and a high heating efficiency.

The atomizer 100 having aforementioned atomizing head 40 and the electronic cigarette having aforementioned atomizing head 40 which are provided by the present disclosure possess a technical effect same as that of aforementioned atomizing head 40.

The Second Embodiment

The difference between the atomizing head 40 provided by the second embodiment and the atomizing head 40 provided by the first embodiment it that: in the second embodiment, the second electrode 44 is provided with a resisting portion 441 protruding inwardly from an inner wall of the second electrode 44. The resisting portion 441 is made of hard conductive materials. The resisting portion 441 defines a conical hole 442 at an upper end of the resisting portion 441, which is arranged along an axial direction of the resisting portion 441. In the second embodiment, the resisting portion 441 extends inwardly along a radial direction of the second electrode 44. When assembled, the lower end of the heater 47 resists the conical hole 442 and is oriented by the conical hole 442, the situation that the heater 47 is separated from the second electrode 44 due to a malposition is avoided. Compared to the first embodiment, the atomizing head 40 of the second embodiment can be firmly assembled.

The Third Embodiment

The difference between the atomizing head 40 provided by the third embodiment and the atomizing head 40 provided by the first embodiment it that: in the third embodiment, the second electrode 44 is provided with a resisting portion 441 protruding inwardly from an inner wall of the second electrode 44. In the third embodiment, the resisting portion 441 is a thin steel sheet extending inwardly along a radial direction of the second electrode 44. It is understood that, the resisting portion 441 is a conductive member possessing elasticity and rigidity. When assembling the heater 47, the heater 47 is pressed into the second electrode 44, the resisting portion 441 is deformed under a pressure effect, so as to press the heater 47 into an inner side of the second electrode 44, the situation that a poor connection of the heater 47 due to a waggle can be avoided. Compared to the first embodiment, the atomizing head 40 of the third embodiment can be firmly connected.

The embodiments described above are merely preferred embodiments, but not intended to limit the application. Any modifications, alternatives or improvements made within the principle and spirit of the present application should be interpreted as falling within the protection scope of the present application.

What is claimed is:

1. An atomizing head, comprising: a bracket forming an atomizing chamber at an inner space thereof; an electrode assembled to an end of the bracket; and a heater received in the atomizing chamber, wherein a first end of the heater resists the electrode.

2. The atomizing head according to claim 1, further comprising a sealing cover sleeved over the bracket from a side opposite to the electrode.

3. The atomizing head according to claim 2, wherein a second end of the heater is electrically connected to a sealing cover.

4. The atomizing head according to claim 2, wherein an end of the sealing cover away from the electrode is bended inwardly along a radial direction of the sealing cover to form a bending portion, and the second end of the heater resists the bending portion.

5. The atomizing head according to claim 1, wherein the heater is a coil wire.

6. The atomizing head according to claim 1, wherein an insulating member is disposed between the electrode and the bracket.

7. The atomizing head according to claim 1, wherein the electrode is substantially a hollow cylindrical structure having an opening, the electrode has a resisting portion protruding inwardly from an inner wall of the electrode.

8. The atomizing head according to claim 1, further comprising an absorbing member received in the atomizing chamber, wherein the absorbing member sleeves over the heater.

9. The atomizing head according to claim 8, wherein a sidewall of the bracket defines a first inlet hole fluidly communicating with the atomizing chamber, a sidewall of the sealing cover defines a second inlet hole fluidly communicating with the first inlet hole, and the absorbing member seals the first inlet hole.

10. The atomizing head according to claim 9, further comprising a liquid stopper, wherein an end surface of the liquid stopper seals the first inlet hole, and an opposite end surface seals the second inlet hole, the liquid stopper is disposed between the bracket and the sealing cover.

11. The atomizing head according to claim 8, wherein the absorbing member is made of materials selected from cotton, ceramic, fiber robes, foamy metal, foamy graphite, and combinations thereof.

12. An electronic cigarette, comprising the atomizing head of claim 1 and a liquid storage tube.

13. An atomizer, comprising an atomizing head, wherein the atomizing head comprises: a bracket forming an atomizing chamber at an inner space thereof; a first electrode assembled to an end of the bracket; a first insulating member disposed between the first electrode and the bracket; and a heater received in the atomizing chamber, wherein a first end of the heater resisting the first electrode.

14. The atomizer according to claim 13, further comprising a liquid storage tube, an upper cover assembly, and a seat assembly, wherein the upper cover assembly is positioned on an end of the liquid storage tube, the seat assembly is positioned on an opposite end of the liquid storage tube, the liquid storage tube has an inner space forming a liquid storage chamber, and the atomizing head is received in the liquid storage tube.

15. The atomizer according to claim 14, wherein the upper cover assembly comprises an upper cover and a mouth piece slidably connected to the upper cover, the upper cover forms a first ventilation pipe and defines an injection hole, the first ventilation pipe fluidly communicates with the atomizing chamber, the injection hole fluidly communicates with the liquid storage chamber, wherein the mouth piece is in fluid communication with the first ventilation pipe and the injection hole.

16. The atomizer according to claim 14, wherein the seat assembly comprises a base seat and a flow regulating member rotatably sleeved on the base seat.

17. The atomizer according to claim 16, wherein the base seat defines an air intake hole at the sidewall thereof, the sidewall of the flow regulating member defines a flow regulating hole corresponding to the air intake hole, and a communication area between the flow regulating hole and the air intake hole is adjustable by a rotation of the flow regulating member.

18. The atomizer according to claim 16, wherein the seat assembly further comprises a second insulating member and a second electrode that are assembled to the base seat.

19. The atomizer according to claim 18, wherein the base seat forms a connector tube in fluid communication with the inner space of the base seat, the connector tube extends downwardly from a central portion of a lower end surface of the base seat along an axial direction of the base seat, the first second electrode is assembled to the connector tube, and the second insulating member is disposed between the second electrode and the connector tube.

* * * * *